US005111524A

United States Patent [19]

Schunk et al.

[11] Patent Number: 5,111,524

[45] Date of Patent: May 5, 1992

[54] SIGNAL TRANSMITTING STEERING CABLE INCLUDING OPTICAL FIBER WITH FLUORESCENT DYE

[75] Inventors: Bernd Schunk, Düsseldorf; Reinfried Stolllewerk, Roetgen; Gerhard Hubricht, Hagen; Jörg Peters, Düsseldorf, all of Fed. Rep. of Germany

[73] Assignee: Rheinmetall GmbH, Düsseldorf, Fed. Rep. of Germany

[21] Appl. No.: 736,643

[22] Filed: Jul. 26, 1991

[30] Foreign Application Priority Data

Aug. 29, 1990 [DE] Fed. Rep. of Germany ..... 4027295

[51] Int. Cl.[5] ..... G02B 6/44; F41G 7/00; A63H 27/00

[52] U.S. Cl. ..... 385/102; 385/147; 385/141; 244/3.12; 244/3.16; 446/231

[58] Field of Search ..... 350/96.10, 96.15, 96.23, 350/96.29, 96.30, 96.33, 96.34; 273/331, 333; 446/146, 231, 243; 244/3.12, 3.16; 174/68.1, 70 R, 110 SR, 137 A, 137 B; 385/101, 102, 128, 145, 147, 141

[56] References Cited

U.S. PATENT DOCUMENTS

| | | | |
|---|---|---|---|
| 4,626,068 | 12/1986 | Caldwell | 350/96.34 |
| 4,884,860 | 12/1989 | Brown | 350/96.15 |
| 4,934,712 | 6/1990 | Byrd | 273/333 |
| 4,950,049 | 8/1990 | Darsey et al. | 350/96.30 |
| 5,005,930 | 4/1991 | Schotter | 350/96.10 |

*Primary Examiner*—Brian Healy
*Attorney, Agent, or Firm*—Spencer, Frank & Schneider

[57] ABSTRACT

A signal transmitting steering cable (4, 40, 40') for remotely-controlled flying bodies (1) which, once the flying body (1) has been launched, can be located and disposed of easily. For this purpose the surface layer (44, 46) of the steering cable (4) includes a material which is fluorescent when illuminated with light of a predetermined wavelength range. Preferably, a dye whose emission spectrum lies approximately between 530 and 690 nm is employed as the fluorescent material.

5 Claims, 2 Drawing Sheets

FIG.1
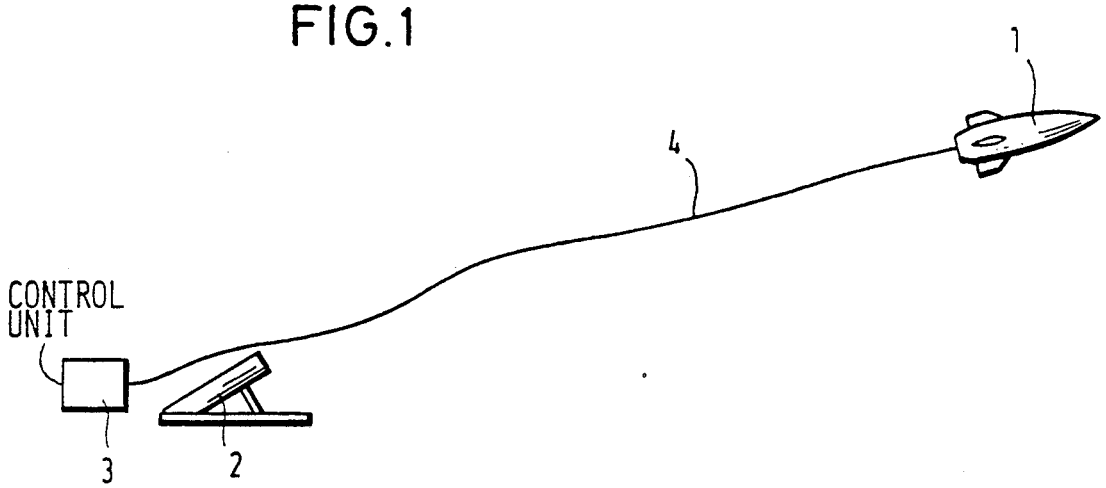
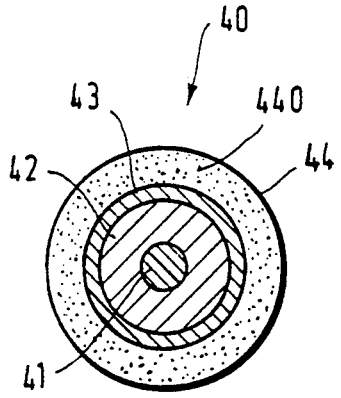
FIG.2
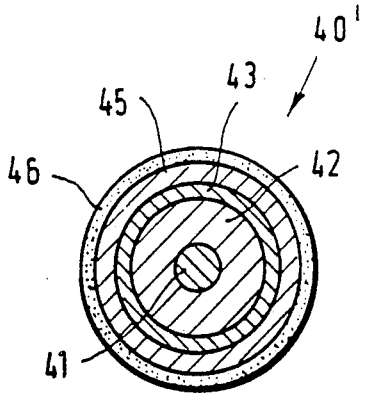
FIG.3

SIGNAL TRANSMITTING STEERING CABLE INCLUDING OPTICAL FIBER WITH FLUORESCENT DYE

REFERENCE TO RELATED APPLICATIONS

This application claims the priority of German application Serial No. P 40 27 295.8 filed Aug. 29th, 1990, which is incorporated herein by reference.

BACKGROUND OF THE INVENTION

The present invention relates to a signal transmitting steering cable for remotely controlled flying bodies.

Electrical cables as well as glass optical waveguides, i.e., fiber-optic conductors, are used to remotely control flying bodies. More recently, however, it is primarily desired to employ fiber-optic conductors to transmit signals because of their greater bandwidth than electrical cables.

A particular drawback in the use of steering cables is that, after launching of the flying body, the cable remains on the terrain. For reasons of environmental compatibility, e.g. danger for animals eating them or getting caught in the wire or glass fibers, it will be necessary in the future to remove the steering cable from the terrain. Up to now, this has not been possible at justifiable expense since, for example, the glass fibers are practically invisible. Rewinding is also not possible, or is possible only in sections, because of the poor tensile strength of the glass fiber.

SUMMARY OF THE INVENTION

It is therefore an object of the present invention to develop a signal conducting steering cable for remotely controlled flying bodies which, after launching of the flying body, can be easily located and disposed of.

The above object is generally achieved according to the present invention, by a signal transmitting steering cable for remotely controlled flying bodies which comprises an inner signal transmitting conductor having a protective surface layer, and wherein the surface layer includes a material which is fluorescent when illuminated with light in a predetermined wavelength range. Preferably the fluorescent material is a fluorescent dye having an emission spectrum including the range between approximately 530 and 680 nm, e.g. benzimidazo-benzisoquinoline-7-one which is fluorescent in response to illumination by light in the ultraviolet range.

The present invention is thus based on the idea of providing the steering cable with a surface coating that becomes fluorescent when irradiated, for example, with UV light. The resulting increased contrast against the environment makes the steering cable more easily visible. This makes possible its manual or automatic disposal.

Further advantages and details of the invention will be described in greater detail below with reference to embodiments thereof and with the aid of drawing figures.

BRIEF DESCRIPTION OF THE DRAWINGS

FIG. 1 is a schematic illustration of a flying body which is connected with a command unit by a steering cable.

FIGS. 2 and 3 show two embodiments of a steering cable according to the present invention.

DETAILED DESCRIPTION OF THE PREFERRED EMBODIMENTS

Figure 4:
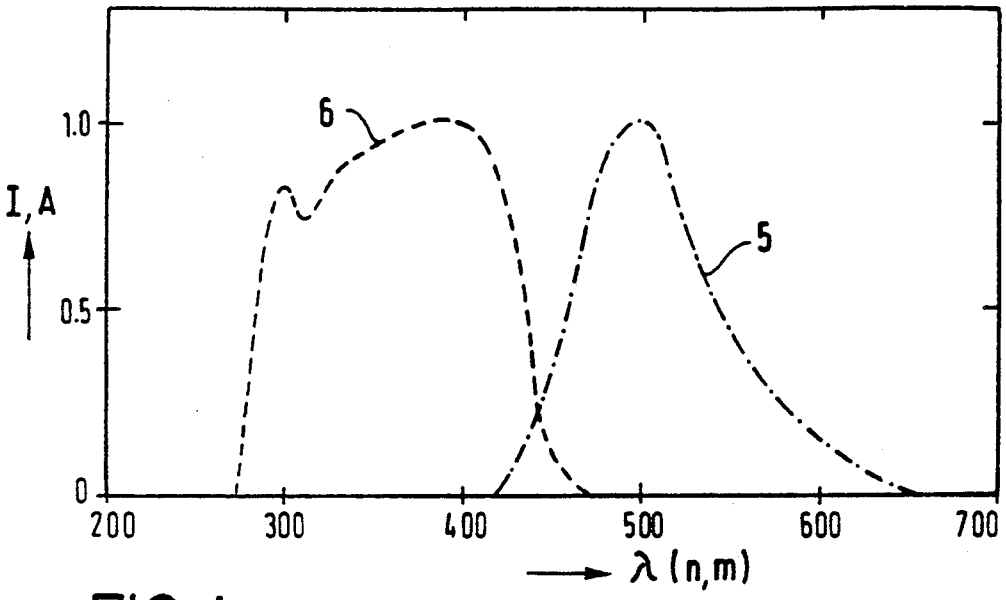
FIGS. 4 and 5 are two diagrams used to explain the invention.

FIG. 1 shows a flying body 1, for example a rocket, which was launched by a launching device 2 and which is connected with a command or control unit 3 by a signal transmitting steering cable 4, preferably an optical waveguide, i.e., a glass fiber-optic conductor.

FIG. 2 shows the configuration of one embodiment of a fiber-optic conductor 40 according to the present invention. Like the prior art fiber optical conductors, it is composed of a glass core 41 having a diameter of, for example, 9 μm, a glass cladding layer 42 surrounding the core 41 to a thickness of, for example, 125 μm, a soft acrylate covering layer 43 (e.g. 20 μm), as well as a hard outer or protective covering layer 44 of, for example, 250 μm, likewise of acrylate. According to the invention, the hard covering layer 44 is doped with a material, for example, a fluorescent dye, whose respective dye particles are marked 440 in the figure. Preferably the fluorescent material has an emission spectrum in the range between about 530 nm and 680 nm since in this range natural vegetation has a reflection minimum to incident light as shown by curve 7 of FIG. 5.

Various materials, for example, organic substances having fluorescent characteristics may be employed as the fluorescent dye material 440. This is the case primarily for benzene derivatives. Particularly suitable for the present application is benzimidazo-benzisoquinoline-7-one (BBQ) because its fluorescence emission band includes the range between about 530 and 680 nm as can be seen from curve 5 of FIG. 4 which indicates the BBQ fluorescent spectrum of a conductor according to the invention as measured in a laboratory. As mentioned above, in the range between about 530 and 680 nm, natural vegetation has a reflection minimum (see curve 7 of FIG. 5) so that a relatively high contrast results between the fluorescent emission of the luminescent glass fiber conductor 40 according to the invention and the surroundings. In FIG. 5, the fluorescent emission of the BBQ containing conductor as measured in the environment is indicated by the curve 5'.

Figure 5:
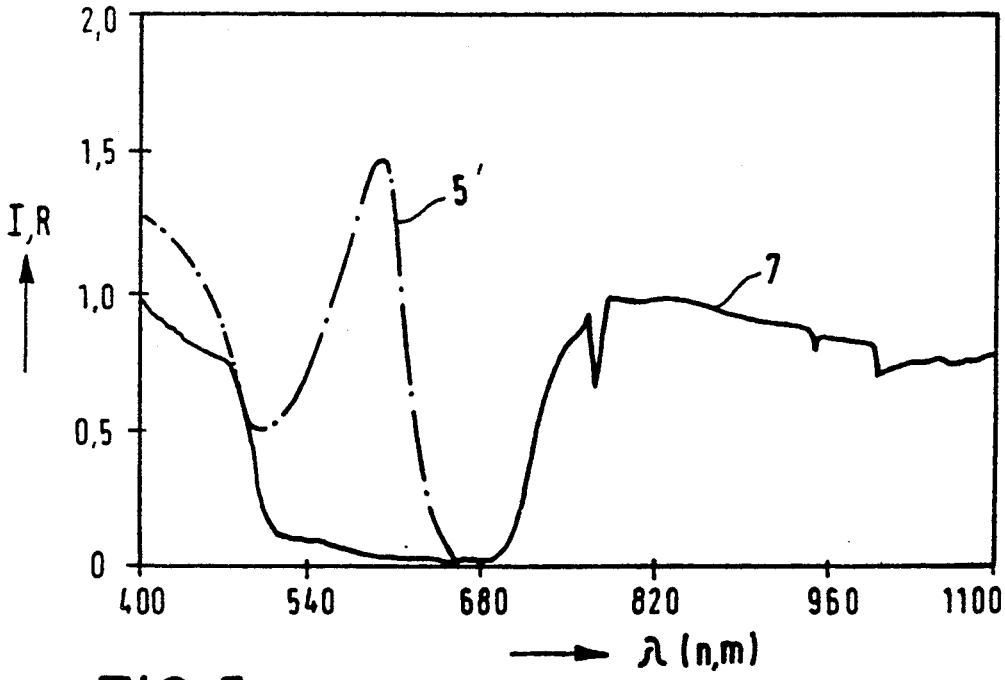

Curve 6 in FIG. 4 shows the absorption spectrum of BBQ. It indicates that irradiation with ultraviolet light (280 to 400 nm) will result in luminescence of the BBQ dye.

For manual recovery, the area in which the optical waveguide of the fiber-optic conductor is presumed to be located is illuminated or scanned by ultraviolet lamps. The luminescent fiber fragments are then collected by hand. For greater efficiency, the collector may wear glasses equipped with filters which permit light in a wavelength range between about 500 and 550 nm to penetrate.

It is also conceivable to automatically dispose of the glass fiber material by means of small vehicles carrying a camera provided with a filter (530 to 560 nm), an image processing system, ultraviolet searchlights and a suction hose for sucking up the glass fibers. With the aid of the limited wavelength fluorescent radiation of the fiber portion, a special image processing algorithm will be able to determine the location of the fiber on the terrain. The image processing unit then calculates the location of the glass fiber and steers the suction hose. The image processing unit is supported by the camera whose filters preferably are transparent for the wavelength range of the fluorescence radiation.

FIG. 3 shows a further embodiment of a light waveguide or fiber-optic conductor 40' according to the invention in which a lacquer layer 46 including a fluorescent dye is additionally applied onto the prior art hard surface coating 45. The thickness of layer 46 may be, for example, 2 μm.

The invention now being fully described, it will be apparent to one of ordinary skill in the art that any changes and modifications can be made thereto without departing from the spirit or scope of the invention as set forth herein.

What is claimed is:

1. A signal transmitting steering cable for remotely controlled flying bodies comprising an inner signal transmitting conductor having a protective surface layer which includes a material which is fluorescent when illuminated with light in a predetermined wavelength range, and wherein said fluorescent material is a fluorescent dye having an emission spectrum including the range between approximately 530 and 680 nm.

2. A steering cable as defined in claim 1, wherein said predetermined wavelength range is in the ultraviolet range.

3. A steering cable as defined in claim 1, wherein said fluorescent material is benzimidazo-benzisoquinoline-7-one.

4. A steering cable as defined in claim 3, wherein said signal transmitting conductor is a fiber-optic conductor.

5. A steering cable as defined in claim 1, wherein said signal transmitting conductor is a fiber-optic conductor.

* * * * *